United States Patent [19]

Shemtov

[11] 4,159,859

[45] Jul. 3, 1979

[54] CRADLE TYPE GROUND LUG FOR CONDUIT

[75] Inventor: Sami Shemtov, Central Islip, N.Y.

[73] Assignee: Gould Inc., East Farmingdale, N.Y.

[21] Appl. No.: 853,096

[22] Filed: Nov. 21, 1977

[51] Int. Cl.[2] ..... H01R 3/06

[52] U.S. Cl. ..... 339/14 L

[58] Field of Search ..... 339/14 L, 14 R, 13

[56] References Cited

U.S. PATENT DOCUMENTS

| | | | |
|---|---|---|---|
| 2,116,474 | 5/1938 | Bondeson | 339/13 |
| 3,365,693 | 1/1968 | Browne | 339/14 L |
| 3,492,625 | 1/1970 | Bromberg | 339/14 R |
| 3,706,959 | 12/1972 | Norden | 339/14 R |
| 3,967,872 | 7/1976 | Mooney et al. | 339/14 L |

*Primary Examiner*—Roy Lake

*Assistant Examiner*—DeWalden W. Jones

*Attorney, Agent, or Firm*—Howard C. Miskin

[57] ABSTRACT

A grounding device includes an internally threaded collar having an end insulator bushing and provided in its outer peripheral face with a radial coupling socket which has regularly circumferentially spaced longitudinal grooves and a tapped axial bore in its base. A wire clamp includes an elongated base provided at an end thereof with a projecting polygonal shank which slideably engages the socket and grooves to permit the selective angular adjustment of and the angular locking of the wire clamp to the collar. A locking and fastening screw engages a bore coaxially formed in the shank and the tapped bore in the socket base. The wire clamp includes a stationary jaw integrally formed with the base and a screw advanced movable jaw.

11 Claims, 6 Drawing Figures

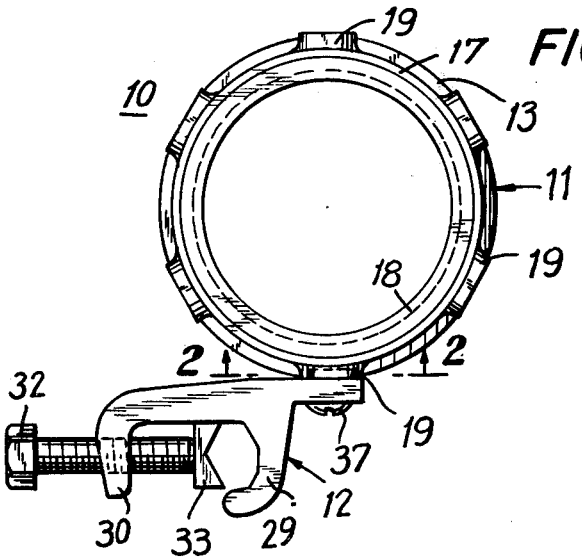
FIG. 1
FIG. 2
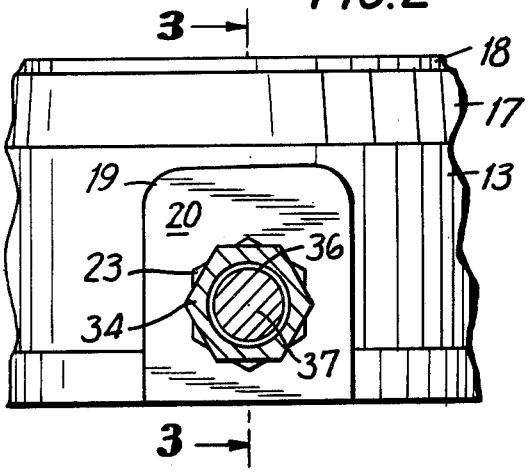
FIG. 3
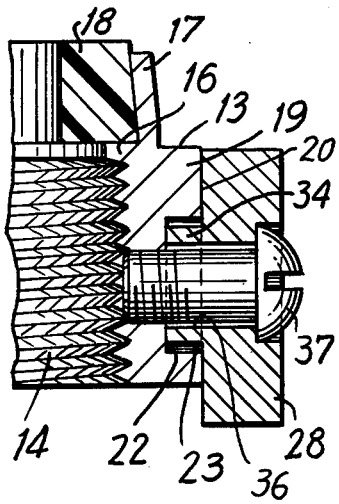
FIG. 5
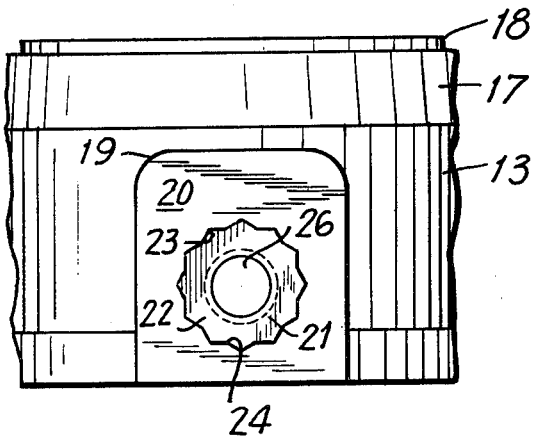
FIG. 4
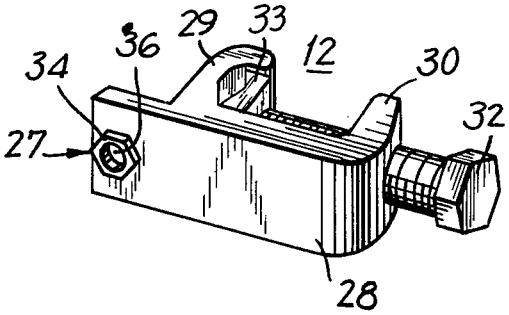

CRADLE TYPE GROUND LUG FOR CONDUIT

BACKGROUND OF THE INVENTION

The present invention relates generally to improvements in electrical connector devices and it relates more particularly to an improved device for connecting a grounding wire to an electrical cable conduit.

It is a highly desirable and a widely common practice in electrical distribution installations to ground the cable carrying conduit and the various service boxes and to this end coupling devices are provided for electrically connecting a grounding conductor to the conduit. A coupling device for this purpose is disclosed in U.S. Pat. No. 3,967,872 issued July 6, 1976 to Thomas Mooney and Richard A. Bauer and includes an internally threaded metal collar for attachment to the threaded end of a cable carrying conduit at the wall of an associated service box and a cable clamping lug screw attached to the collar peripheral face. While the above coupling device possesses numerous advantages it has drawbacks. There is no structure positively restricting the angular movement of the clamp lug on the collar so that there is no assurance that the assembly will withstand any heavy mechanical or electrical stress and is hence frequently unreliable. Furthermore, the coupling mounting depends on the proper tightening of the attaching screw and this is frequently an awkward inconvenient and often time-consuming procedure, and leaves much to be desired.

SUMMARY OF THE INVENTION

It is accordingly a principal object of the present invention to provide an improved electrical connector device.

Another object of the present invention is to provide an improved device for firmly electrically connecting a grounding cable to an electrical cable carrying conduit.

Still another object of the present invention is to provide an improved electrical connecter device in which a cable clamp or lug is angularly adjustably secured to a collar for attachment to an electrical conduit.

A further object of the present invention is to provide an improved device of the above nature characterized by its reliability, ruggedness, simplicity, low cost, ease of application and great versatility and adaptability.

The above and other objects of the present invention will become apparent from a reading of the following description taken in conjunction with accompanying drawing which illustrates a preferred embodiment thereof.

In a sense, the present invention contemplates the provision of an improved wire coupling device comprising a metal coupling member electrically and mechanically connectable to a member to be grounded and including a first coupling section, a wire connector member including a second coupling section coaxially engageable with the first coupling section in a plurality of preselected relatively angularly related positions and being positively restricted against axial rotating from a preselected angular position when in a coupling section engaged condition and means for releaseably locking the wire connecter member to the coupling member with the coupling sections in mutual engagement.

In a preferred form of the improved wire coupling device, the coupling member is an internally threaded collar which is attachable to the externally threaded end of an electrical conduit and which has a socket formed in its outer peripheral face. The socket has a plurality, for example twelve, regularly circumferentially spaced longitudinal angular slots formed in its peripheral face and a tapped axial bore in its base. The wire connecter member may be of any suitable construction and is advantageously of the screw tightened clamp type, and includes a coupling shank of polygonal transverse cross-section, for example, hexagonal and is of dimensions so as to axially slideably engage the socket. An axial bore is formed in the shank and is engaged by a screw which engages the tapped bore in the socket to interlock the socket and shank. In assembling the coupling and wire connector members, they are brought to the desired angular relationship and the shank inserted into the socket with corners of the shank slideably matingly engaging respective longitudinal slots in the socket and the screw is then tightened to complete the assembly in the desired angular relationship.

The angular relationship between the wire connector and coupler member is adjustable and positively firmly retained in its preselected relationship. The device is reliable, rugged, of simple construction, easy to apply and of great versatility and adaptability.

BRIEF DESCRIPTION OF THE DRAWINGS

FIG. 1 is an end elevational view of a conduit electrical coupling device embodying the present invention;

FIG. 2 is a sectional view taken along line 2—2 in FIG. 1;

FIG. 3 is a sectional view taken along line 3—3 in FIG. 2;

FIG. 4 is a bottom perspective view of the cable connected member forming part of the device of FIG. 1;

FIG. 5 is a view similar to FIG. 1 but without the cable connecter member and securing screw.

DESCRIPTION OF THE PREFERRED EMBODIMENT

Figure 6:
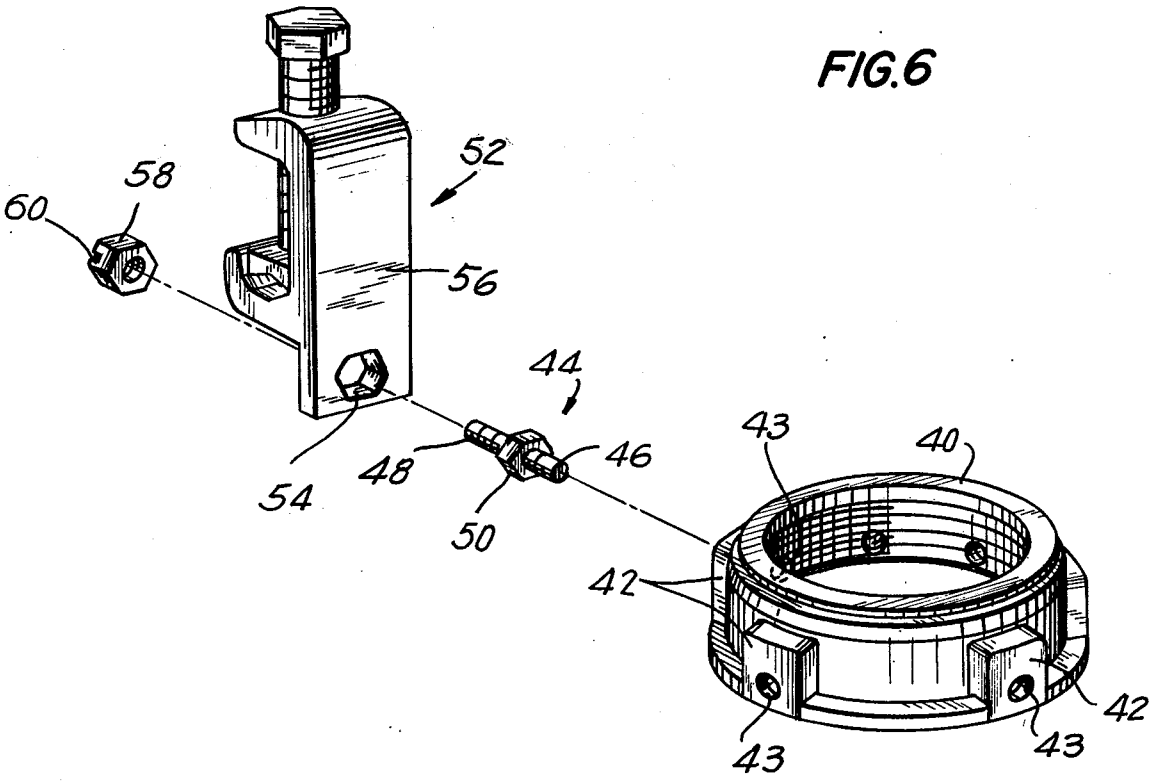
FIG. 6 is an exploded view showing another embodiment.

Referring now to the drawing which illustrates a preferred embodiment of the present invention, the reference numeral 10 generally designates the improved cable electrical conduit coupling device which includes a conduit coupling member 11 and a cable connector member 12 angularly adjustably secured to the coupling member 11.

The conduit coupling member 11 comprises a circular metal collar 13 internally threaded, as at 14, to permit the screw coupling of the collar 13 to the externally threaded end of a conventional electrical conduit. Formed at the outer end of collar 13 is an inwardly directed peripheral stop flange 16 and projecting forwardly from the front end of collar 13 is an inwardly forwardly inclined peripheral wall 17. Nesting and retained in the space delineated by the adjacent faces of flange 16 and wall 17 is a bushing 18 projecting forwardly and inwardly of the delineated space and formed of a low friction synthetic organic polymeric resin to provide a non-abrasive guide for cable passing through the collar 13.

Integrally formed with the outer face of the collar 13 are a plurality, for example six, of regularly circumferentially spaced radially projecting tool accommodating protuberances or tables 19 having flat outer faces 20 lying along tangent to a circle coaxial with collar 13. A non-circular well or socket 21 is formed in the outer face 20 of one or more of the tables 19 and has a flat base 22. The socket 21 has a serrated peripheral face with similar plurality of linearly longitudinally extending regularly circumferentially spaced grooves 23 separated by intervening longitudinal ridges 24, the grooves 23 having symetrically opposed angularly related planar faces. While twelve grooves 23 have shown this number can be varied as will be hereinafter explained. A tapped bore 26 is coaxially formed in the socket base 22.

The cable lug or connector member 12 may be of any suitable type and includes a coupling section 27 which cooperates with the coupling section defined by socket 21. In the illustrated form the connector member includes an elongated base having formed inwardly of one end thereof a transversely projecting curved stationary pad or jaw 29 with a concave face directed toward the opposite end of the base at which is integrally formed a transversely projecting post 30 having a tapped longitudinal bore. A clamp tightening hex bolt 32 engages the aforesaid tapped bolt and projects toward stationary jaw 29 and is provided at its inner end with a relatively rotatably mounted longitudinally movable jaw 33 which is slideable with the rotation of bolt 32 toward and away from the stationary jaw 29. The face of jaw 33 facing jaw 32 is angular and concave in the known manner.

The coupling section 27 comprises a short stub shank 34 integrally formed and projecting from the underface of base 28 outwardly of jaw 29 and is of hexagonal transverse cross-section and of a height approximately equal to the depth of socket 21 with a flat end face. It should be noted that the shank 34 may be of other polygonal configuration, with the number of socket grooves 23 being an integral multiple of the number of corners of the polygon, that is either the same number or twice or more as many. Furthermore, the shank 34 and socket 21 are so dimensioned that in their coupled condition the corners of the shank matingly, firmly and smoothly slideably engage the socket grooves 23. An axial bore 36 is formed in the shank 34 and extends through the base 28.

In the assembled condition of the coupling device 10 the shank 34 nests in the socket 23 with the cable connected or lug 12 being at the preselected angle relative to the collar 13, the angle of the lug 12 being positively fixed by reason of the mutual engagement between the shank corners and the socket grooves. The connector member 12 and collar 13 are secured or locked in the preselected position by a screw 37 engaging shank bore 36 and tapped socket bore 26.

The operation and application of the improved cabling coupling device 10 are clear from the above description. Thus, in one procedure, the threaded end of an electrical conduit is inserted through the wall of a service box by way of an opening therein and the coupling member 11, is then tightly screwed to the end of the conduit within the service box. The connector member 12 is then applied to the coupling collar 13 at the desired point and at the desired angle thereto with the shank 34 in nesting engagement with the socket 21 and the assembly is tightened by the application and tightening of the screw 37. The cable clamp 12 of the coupling device 10 is now ready to receive a grounding cable and may be tightened by turning the bolt 32 to close the cable clamp without altering the position of the connector member.

Another embodiment is illustrated in FIG. 6 which shows an exploded view of this embodiment. A metal collar 40, a portion of which is shown, is generally similar to collar 13 described above. Collar 40 has spaced apart radially projecting protuberances or tables 42 which corresponds to flat 19 described above. Table 42 has a tapped bore 43 formed therein. Fastener 44 has a threaded portion 46 at one end which threadedly mates with tapped bore 43. At the opposite end is a threaded portion 48, and advantageously disposed between threaded portions 46 and 48 is a portion adapted to be rotated by a wrench, and thus has flattened portions adapted to mate with a conventional wrench. The cable lug or connecting member 52 is generally similar to lug 12 described above, having generally similar jaws and the clamp bolt which will not be further described. An axial bore 54 passes through the base 56 of connecter member 52. Bore 54 is of hexagonal transverse cross-section and may be of other polygonal configuration. A cap or nut 58 has an outer configuration of generally hexagonal shape and of a height approximately equal to the depth of bore 54. The outer end of nut 58 is slotted, such as illustrated at 60 to provide for rotation by a screw driver. The configuration of bolt 58 may be of other polygonal configuration with the number of socket grooves in bore 56 being an integral multiple of the number of corners of the polygon, so as to readily mate. The configuration of bolt or nut 58 and socket or bore 56 are so dimensioned that in their coupled condition the corners of the nut 58 matingly, firmly and smoothly slideably engage the socket grooves 54.

In use, nut 58 is positioned in bore 56 and the threaded end 48 of fastener 44 is threaded onto nut 58 until tight. The threaded end 46 of member 44 with lug 52 is threaded into tapped bore 43 on connector member 40 until tight, and the connector member 52 is at the desired point and desired angle with respect to connector member 40.

While lugs 12 and 52 are shown to be grounding lugs, any other type of lugs or connectors which are desired to be fixedly positioned onto another connector member to be used. Also, the under surface of the pad 33 and the inner surface of jaw 29 of the lug advantageously are roughened or have serrations which allows the pad and surface to break any oxide surface of the connecting wire, such as ground wire placed in the lug to form good electrical connection.

While there has been described and illustrated a preferred embodiment of the present invention, it is apparent that numerous alterations, omissions and additions may be made without departing from the spirit thereof.

I claim:

1. An electrical cable coupling device comprising a metal coupling member electrically and mechanically connectable to a member of an electrical installation and including a first coupling section, a wire connnector member including a second coupling section coaxially engageable with said first coupling section in a plurality of discrete preselected, incremently separated relatively angularly related positions, one of said coupling sections including a plurality of peripherally spaced radially offset first longitudinally extending abutment faces and the other of said coupling sections including at least one radially offset second abutment face whereby when said coupling sections are in engaged position said second abutment face engages a first abutment face to postively restrict said wire connector member against axial rotation from a preselected angular position and means for releasably locking said wire connector member to said coupling member with said coupling sections in mutual engagement.

2. The electrical coupling device of claim 1 wherein one of said coupling sections includes a socket of non-circular transverse cross-section and the other of said coupling sections includes a shank of non-circular transverse cross-section engageable with said socket.

3. The electrical coupling device of claim 1 wherein said coupling member comprises an internally threaded collar attachable to the externally threaded end of an electrical cable conduit.

4. The electrical coupling device of claim 3 wherein said socket is formed in the outer peripheral face of said collar and said shank defines said second coupling section.

5. The electrical coupling device of claim 2 wherein said socket has a plurality of circumferentially spaced longitudinally extending grooves formed in the peripheral face thereof, said shank includes a radial projection longitudinally slideably engaging a preselected socket groove.

6. An electrical cable coupling device comprising a metal coupling member electrically and mechanically connectable to a member of an electrical installation and including a first coupling section, a wire connector including a second coupling section engageable with said first coupling section in a plurality of preselected relatively angularly related positions, one of said coupling sections includes a socket having a plurality of circumferentially spaced longitudinally extending grooves formed in the peripheral base thereof and the other of said coupling sections includes a shank of polygonal transverse cross-section engagable with said socket, said socket grooves being regularly circumferentially spaced and of a number which is an integral multiple of the number of corner edges of said shank, and means for releasably locking said wire connector member to said coupling member with said coupling sections in mutual engagment.

7. The electrical coupling device of claim 3 wherein said socket has a tapped coaxial bore formed in the base thereof, said shank has a coaxial bore formed therein and said locking means comprises a screw engaging said bores.

8. The electrical coupling device of claim 1 wherein said wire connector member comprises a wire clamp.

9. The electrical coupling device of claim 8 wherein said wire clamp comprises a body member having one of said coupling sections formed thereon, and including an integrally formed stationary jaw and a post longitudinally spaced from said stationary jaw and having a tapped longitudinal bore, and a screw engaging said tapped bore and longitudinally axially movable.

10. The electrical coupling device of claim 9 including a jaw member longitudinally movable along said body member toward and away from said stationary jaw and lying in the axial path of said screw.

11. The electrical coupling device of claim 1 wherein one of said coupling sections includes a circularly extending serrated face and the other of said coupling sections has at least one projection releaseably engaging a depressed portion of said serrated face.

* * * * *